US008701877B1

(12) United States Patent
Elmasri et al.

(10) Patent No.: US 8,701,877 B1
(45) Date of Patent: Apr. 22, 2014

(54) CONTAINER FOR STORING DEVICES WITH ENERGETIC MATERIAL

(75) Inventors: Bishara Elmasri, Landing, NJ (US); Timothy Woo, Flushing, NY (US); Leon Moy, Montclair, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 172 days.

(21) Appl. No.: 13/248,191

(22) Filed: Sep. 29, 2011

(51) Int. Cl.
*F42B 39/26* (2006.01)

(52) U.S. Cl.
USPC ..... 206/3

(58) Field of Classification Search
USPC ..... 206/3, 317, 775, 776, 777; 89/33.1, 34
See application file for complete search history.

(56) References Cited

U.S. PATENT DOCUMENTS

| | | | | | |
|---|---|---|---|---|---|
| 2,566,569 | A * | 9/1951 | Jensen | 206/3 |
| 3,039,650 | A * | 6/1962 | Hoffmann | 206/3 |
| 3,757,933 | A * | 9/1973 | Banta | 206/3 |
| 4,194,657 | A * | 3/1980 | Thor | 206/3 |
| 5,676,241 | A * | 10/1997 | Degoix et al. | 206/3 |
| 5,829,586 | A * | 11/1998 | Mermell | 206/317 |
| 6,336,552 | B1 * | 1/2002 | Meier | 206/3 |
| 7,395,922 | B1 * | 7/2008 | Sinha | 206/3 |
| 7,546,794 | B1 * | 6/2009 | Sarles et al. | 206/3 |

* cited by examiner

*Primary Examiner* — Luan K Bui
(74) *Attorney, Agent, or Firm* — Michael C. Sachs

(57) ABSTRACT

A storage container for storing a device containing energetic material may include a metal wall. A venting window may be disposed in the metal wall. The venting window may include a plurality of metal supports that define a plurality of openings therebetween. An ionomer material may cover the plurality of openings. The ionomer material may have a melting temperature lower than an ignition temperature of the energetic material in the device.

4 Claims, 4 Drawing Sheets

Fig. 1A
PRIOR ART
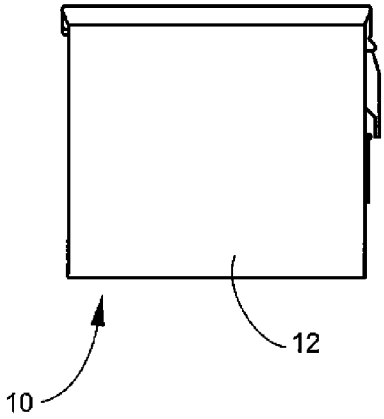
Fig. 1B
PRIOR ART
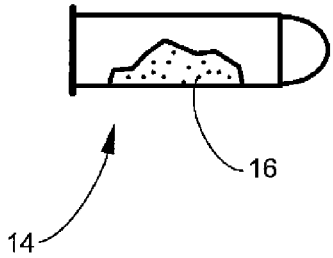
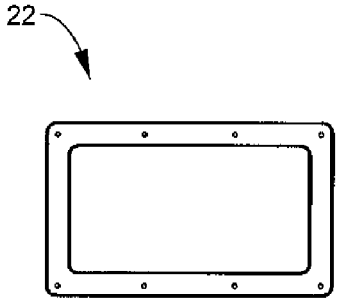
Fig. 2
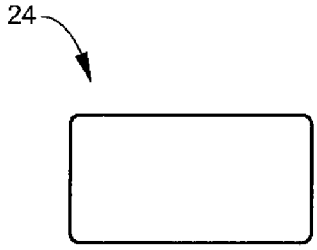
Fig. 3
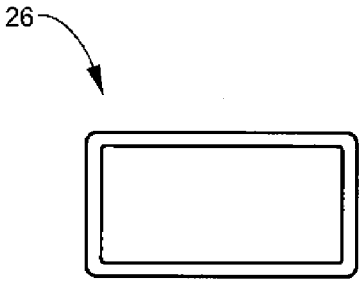
Fig. 4
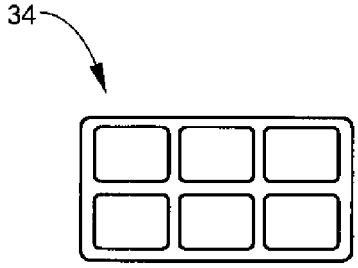
Fig. 5

CONTAINER FOR STORING DEVICES WITH ENERGETIC MATERIAL

STATEMENT OF GOVERNMENT INTEREST

The inventions described herein may be manufactured, used and licensed by or for the U.S. Government for U.S. Government purposes.

BACKGROUND OF THE INVENTION

The invention relates in general to storage containers for devices containing energetic material and in particular to storage containers that meet insensitive munitions (IM) requirements.

Containers may be used to store devices containing energetic material. For example, ammunition containers may be used to store one or more munitions. The munitions may contain energetic material that may produce gas when subjected to unplanned stimuli. This gas may require a way to escape from the ammunition container in a non-violent way. Ammuntion containers for munitions may be required to comply with Insensitive Munitions (IM) requirements set forth in MIL-STD-2105C and Ammunition Packaging requirements set forth in MIL-STD-1904A.

Regarding IM requirements, two tests may be used to simulate ammunition containers exposed to a fire, a slow cook off test (SCO) and a fast cook off test (FCO). In SCO, an ammunition container containing one or more munitions may be heated at a rate of 6° F./hour until the munition reacts. In FCO, an ammunition container containing one or more munitions may be engulfed in a flame of at least 800° C. until the munition reacts. It may be desirable for the reaction to be limited to no more than burning (Type 5 reaction). A detonation (Type 1 reaction) may not be acceptable.

One way to comply with IM requirements for ammunition containers is to include a venting window in the ammunition container. High pressure and/or temperature produced by munitions in the ammunition container may cause the venting window in the ammunition container to rupture or open, thereby releasing the high pressure gas before the munition in the container undergoes a violent reaction. But, the venting window must be strong enough to meet rough handling requirements for ammunition containers. Before and after the rough handling tests, the ammunition container must be able to contain an internal air pressure of at least three psi with a leakage rate of no more than five cc/minute.

Venting windows have been successfully used in ammunition containers such as the Modular Artillery Charge System (MACS) ammunition container. For the MACS container, the venting window was made of a glass-filled ionomer plastic. To pass rough handling tests, the ionomer plastic had to be at least 40% glass-filled. Ionomer plastic vent windows with a glass fill higher than 40% were found to inhibit the venting of the window. When the venting window of the MACS container was used in other ammunition containers, such as, for example, a PA19 container, the vent window failed to open during cook off tests. Reducing the percentage of glass fill in the venting window or decreasing the thickness of the venting window allowed the venting window to rupture. On the other hand, neither the reduced-glass content venting window nor the thinner venting window passed the rough handling requirements.

A need exists for a storage container for devices with energetic material wherein the storage container meets both IM requirements and rough handling requirements.

SUMMARY OF THE INVENTION

It is an object of the invention to provide a storage container for devices with energetic material wherein the storage container meets both IM requirements and rough handling requirements.

One aspect of the invention is a storage container for storing a device containing energetic material. The storage container may include a metal wall and a venting window disposed in the metal wall. The venting window may include a plurality of metal supports that define a plurality of openings therebetween and ionomer material that covers the plurality of openings. The ionomer material may have a melting temperature lower than an ignition temperature of the energetic material in the device. The storage container may include glass fill disposed in the ionomer material. The device or devices stored in the container may be, for example, munitions.

In one embodiment, the plurality of openings may be perforations formed in the metal wall, the metal supports may be portions of the metal wall, and the ionomer material may comprise an ionomer plate. In this embodiment, the storage container may further include an inner frame fixed to the metal wall and surrounding the plurality of openings in the metal wall. The ionomer plate may be inserted into the inner frame and over the plurality of openings in the metal wall. An outer frame may be fixed to the metal wall. The outer frame may lock the ionomer plate between the inner frame and the outer frame.

In another embodiment, the metal wall may define an opening for the venting window, the plurality of metal supports that define the plurality of openings therebetween may comprise a perforated metal plate, and the ionomer material may comprise an ionomer plate. In this embodiment, the storage container may further include an inner frame fixed to the metal wall and surrounding the opening for the venting window. The perforated metal plate may be inserted into the inner frame and over the opening for the venting window. The ionomer plate may be inserted into the inner frame and over the perforated metal plate. An outer frame may be fixed to the metal wall. The outer frame may lock the perforated metal plate and the ionomer plate between the inner frame and the outer frame.

In a further embodiment, the metal wall may define an opening for the venting window, the plurality of metal supports that define the plurality of openings therebetween may comprise a perforated metal plate, and the perforated metal plate may be embedded in the ionomer material. The embedded plate and the ionomer material may define a reinforced ionomer plate. In this embodiment, the storage container may further include an inner frame fixed to the metal wall and surrounding the opening for the venting window. The reinforced ionomer plate may be inserted into the inner frame and over the opening for the venting window. An outer frame may be fixed to the metal wall. The outer frame may lock the reinforced ionomer plate between the inner frame and the outer frame.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1A is a side view of a prior art storage container for devices containing energetic material and FIG. 1B is a schematic view of a device containing energetic material.

FIG. 2 is a side view of an inner window frame for a venting window of a storage container.

FIG. 3 is a side view of an ionomer plate for a venting window of a storage container.

FIG. 4 is a side view of a gasket for a venting window of a storage container.

FIG. 5 is a side view of a perforated steel plate for a venting window of a storage container.

DETAILED DESCRIPTION OF THE PREFERRED EMBODIMENTS

FIG. 1A is a side view of a prior art storage container 10 for storing devices 14 (FIG. 1B) containing energetic material 16. Container 10 may include a metal wall 12. Device 14 may be, for example, a munition. Energetic material 16 may be, for example, a propellant or an explosive. Container 10 may be, for example, an ammunition container.

Embodiments of a novel storage container will be described by referring to methods of modifying storage container 10 by the addition of a venting window. However, one need not construct the novel storage containers by starting with the prior art storage container 10. Many different methods of constructing the novel storage containers are possible. The addition of a venting window to storage container 10 may meet the IM requirements of MIL-STD-2105C and the Ammunition Packaging requirements of MIL-STD-1904A.

Figure 8A:
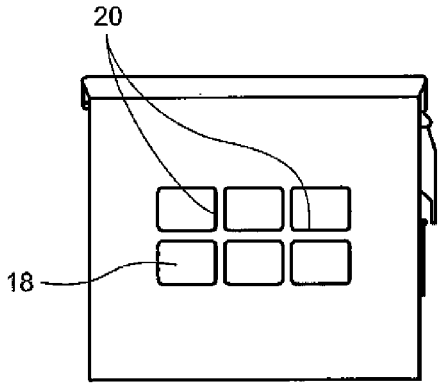
FIGS. 8A-8D illustrate one method of making a venting window for a storage container.
Figure 8B:
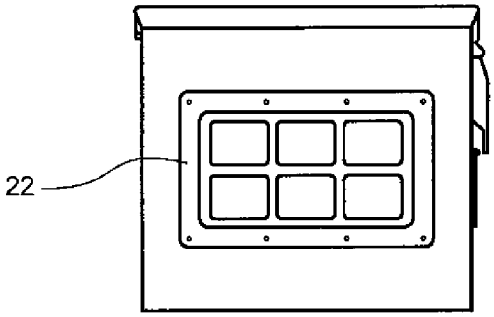

FIGS. 8A-8D illustrate one method of making a venting window in storage container 10. Referring to FIG. 8A, a plurality of openings or perforations 18 may be formed in metal wall 12 of container 10. Forming perforations 18 may create metal supports 20 that are portions of metal wall 12. In FIG. 8B, an inner frame 22 (FIG. 2) may be fixed to metal wall 12. Inner frame 22 may completely surround the plurality of openings 18 in metal wall 12. Inner frame 22 may be fixed to wall 12 by, for example, brazing.

Figure 7:
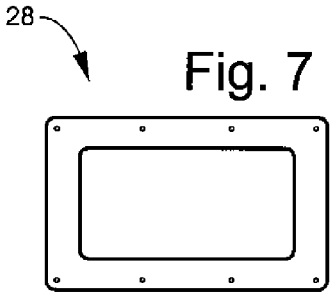
FIG. 7 is a side view of an outer frame for a venting window of a storage container.
Figure 8C:
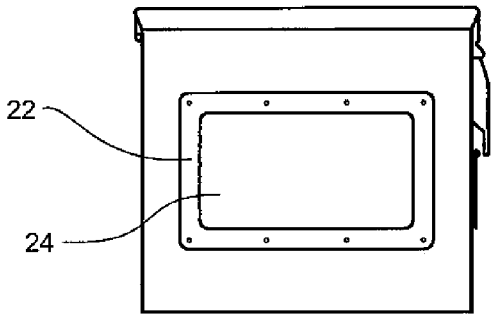
Figure 8D:
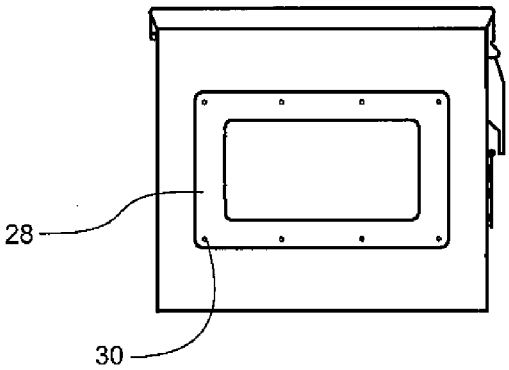

In FIG. 8C, an ionomer plate 24 (FIG. 3) may be inserted into inner frame 22. Ionomer plate 24 may completely cover the plurality of openings 18 in metal wall 12. Ionomer plate 24 may include glass fill. Ionomer plate 24 may have a melting temperature lower than an ignition temperature of energetic material 16 (FIG. 1B) in device 14. In one embodiment, an amount of glass fill in plate 24 may be less than about 40%. In FIG. 8D, a gasket 26 (FIG. 4) and an outer frame 28 (FIG. 7) may be fixed to inner frame 22 and wall 12 using, for example, bolts 30. Outer frame 28 may lock ionomer plate 24 between inner frame 22 and outer frame 28.

Figure 9A:
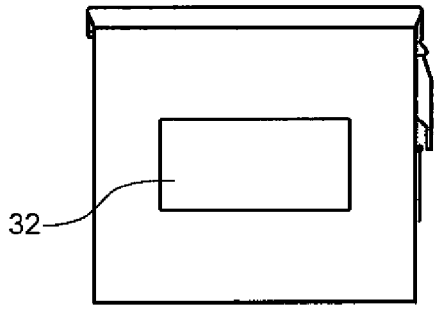
FIGS. 9A-E illustrate another method of making a venting window for a storage container.
Figure 9B:
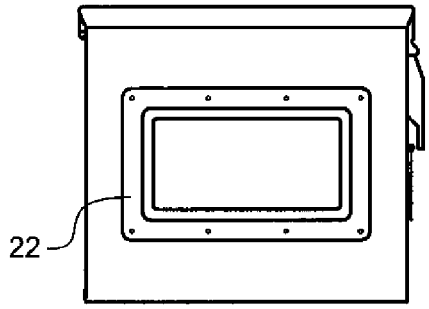

FIGS. 9A-E illustrate another method of making a venting window for storage container 10. Referring to FIG. 9A, an opening 32 may be formed in metal wall 12 of container 10. In FIG. 9B, an inner frame 22 (FIG. 2) may be fixed to metal wall 12. Inner frame 22 may completely surround opening 32 in metal wall 12. Inner frame 22 may be fixed to wall 12 by, for example, brazing.

Figure 9C:
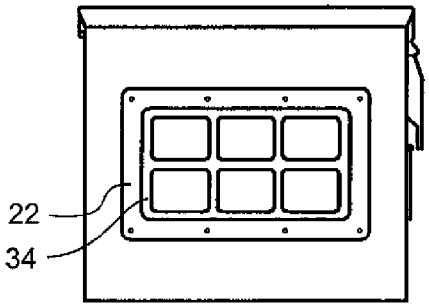
Figure 9D:
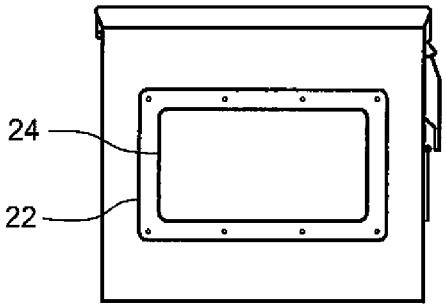
Figure 9E:
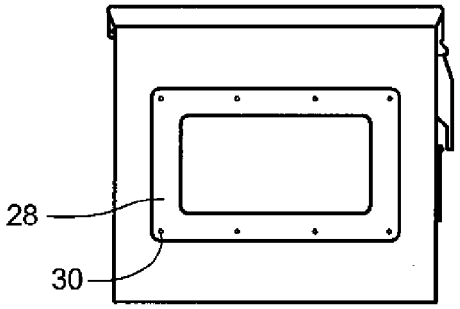

In FIG. 9C, a perforated metal plate 34 (FIG. 5) may be inserted into inner frame 22. Perforated metal plate 34 may cover opening 32 in wall 12. In FIG. 9D, an ionomer plate 24 (FIG. 3) may be inserted into inner frame 22 over perforated metal plate 34. Ionomer plate 24 may cover perforated metal plate 34. Ionomer plate 24 may include glass fill. Ionomer plate 24 may have a melting temperature lower than an ignition temperature of energetic material 16 (FIG. 1B) in device 14. In one embodiment, an amount of glass fill in plate 24 may be less than about 40%. In FIG. 9E, gasket 26 (FIG. 4) and outer frame 28 (FIG. 7) may be fixed to inner frame 22 and wall 12 using, for example, bolts 30. Outer frame 28 may lock perforated metal plate 34 and ionomer plate 24 between inner frame 22 and outer frame 28.

Figure 6:
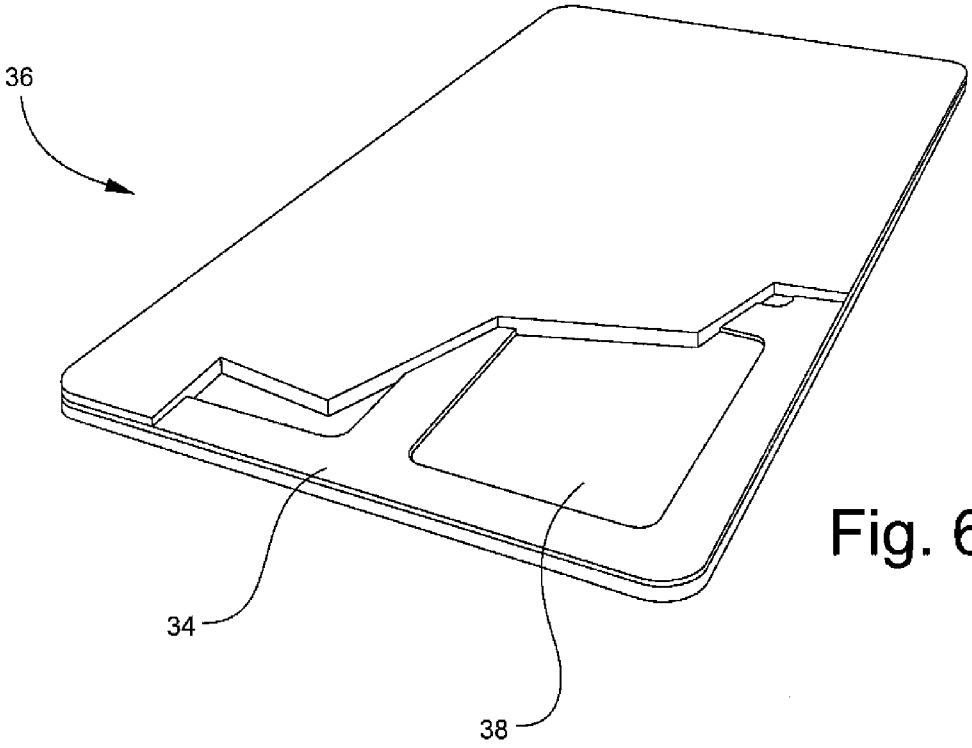
FIG. 6 is a perspective view, partially cut away, of a reinforced ionomer plate for a venting window of a storage container.

As an alternative to perforated metal plate 34 and ionomer plate 24, a reinforced ionomer plate 36 (FIG. 6) may be inserted into inner frame 22 after frame 22 is fixed to wall 12 over opening 32. Then, gasket 26 (FIG. 4) and outer frame 28 (FIG. 7) may be fixed to inner frame 22 and wall 12 using, for example, bolts 30. Reinforced ionomer plate 36 (FIG. 6) may include a perforated metal plate, such as plate 34 (FIG. 5) embedded in ionomer material 38. Reinforced ionomer plate 36 may be formed, for example, by injection molding. Ionomer material 38 in reinforced ionomer plate 36 may have a melting temperature lower than an ignition temperature of energetic material 16 (FIG. 1B) in device 14.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A storage container for storing a device containing energetic material, the storage container comprising:

a metal wall; and a venting window disposed in the metal wall, the venting window including a plurality of metal supports that define a plurality of openings therebetween; and ionomer material that covers the plurality of openings, the ionomer material having a melting temperature lower than an ignition temperature of the energetic material in the device, wherein the metal wall defines an opening for the venting window, the plurality of metal supports that define the plurality of openings therebetween comprise a perforated metal plate, the perforated metal plate being embedded in the ionomer material, the embedded plate and the ionomer material comprising a reinforced ionomer plate, the storage container further comprising an inner frame fixed to the metal wail and surrounding the opening for the venting window, the reinforced ionomer plate being inserted into the inner frame and over the opening for the venting window; and an outer frame fixed to the metal wall, the outer frame locking the reinforced ionomer plate between the inner frame and the outer frame.

2. The storage container of claim 1, further comprising glass fill disposed in the ionomer material.

3. The storage container of claim 2, wherein the glass fill comprises less than 40% of the ionomer material.

4. The storage container of claim 1, wherein the device is a munition and the storage container meets the requirements of MIL-STD-2105C and MIL-STD-1904A.

* * * * *